United States Patent [19]

Swann

[11] Patent Number: 5,022,636

[45] Date of Patent: Jun. 11, 1991

[54] WORKHOLDING APPARATUS

[75] Inventor: George R. Swann, Gibsonia, Pa.

[73] Assignee: Chick Machine Tool Inc., Warrendale, Pa.

[21] Appl. No.: 499,246

[22] Filed: Mar. 26, 1990

[51] Int. Cl.[5] ..... B25B 1/20

[52] U.S. Cl. ..... 269/43; 269/154; 269/244; 269/906

[58] Field of Search ..... 269/43, 136, 138, 152, 269/153, 154, 242, 906, 244, 246, 247

[56] References Cited

U.S. PATENT DOCUMENTS 4,529,183 7/1985 Krason et al. ..... 269/43

4,934,674 6/1990 Bernstein ..... 269/154

*Primary Examiner*—Robert C. Watson

*Attorney, Agent, or Firm*—Kirkpatrick & Lockhart

[57] ABSTRACT

Apparatus for holding two workpieces, each with respect to a fixed reference location, is disclosed. The apparatus includes a base to which a fixed central jaw member is secured. A clamping assembly which includes a first slide member and a second slide member which are joined by a threaded screw shaft is provided for movement relative to the central jaw member. A biasing means is attached to the first slide member by means of a compression spring assembly and may be either displaced with the first slide assembly or secured to the base. When the biasing means is secured to the base member and the first slide is displaced away therefrom, a biasing force is generated so as to urge the second slide member toward the central jaw to hold a workpiece therebetween. As such, one workpiece may be retained or released prior to another workpiece. Further, the instant construction provides the biasing feature without requiring any increase in overall vise length.

3 Claims, 3 Drawing Sheets

WORKHOLDING APPARATUS

BACKGROUND OF THE INVENTION

1. Field of the Invention

The present invention relates to workholding apparatuses and, in particular, to a device for holding two work- pieces relative to a known reference location which is capable of sequentially holding and releasing the workpieces.

2. Description of the Invention Background

As the apparatuses for performing machining operations on workpieces have become more sophisticated, the need has arisen for the apparatus for holding workpieces during such machining operations to be functional so as to allow the complete benefit afforded by such modern-day machining apparatuses. One prior form of workpiece holding apparatus is disclosed in Krason, et al., U.S. Pat. No. 4,529,183, issued July 16, 1985, entitled "Method of Machining and Vise for Use Therein". In that patent, apparatus was disclosed for holding two workpieces, each with respect to a fixed reference location. However, I have discovered that such apparatus may be improved to provide greater even utility to the machinist.

The workholding system described in the above-mntioned patent incorporates a base member having a central jaw member secured thereto. A slide assembly is provided first slide and a second slide, each mounted on the base for sliding movement, and a screw shaft for coupling and moving the slide members. As such, that apparatus provides a free-floating clamping assembly relative to the central jaw member. In the operation of such apparatus, when one workpiece or part is clamped between one slide member and the fixed jaw member, an operator would normally use one hand to hold the workpiece and the other to turn the screw shaft to advance the slide relative to the first workpiece. Unfortunately, because the operator's hands are engaged in the above-described activities, he does not have a free hand available to place another part between the other slide member and the central jaw. If the one part was released to position the other part, then the one part could be displaced from its workholding position, assuming that the friction inherent in the vise is insufficient to immobilize the one slide member. Therefore, I have discovered the need for a mechanism to act as a "third hand" for the operator to allow for the positioning of the workpieces and the simultaneous operation of the screw shaft.

Another shortcoming with the prior workholding system relates to the removal of the workpieces from the workholding system. It will be appreciated that when the screw shaft is rotated, both parts will simultaneously be released. As such, and especially if the work holding system is disposed in a nonhorizontal configuration, when one hand of an operator is used to rotate the shaft, the other hand may only remove one part while the other part may unintentionally drop from the workholding system, possibly damaging the costly, machined part.

One prior art apparatus which, perhaps unintentionally, alleviates certain of the aforementioned problems is produced by Kurt Manufacturing Company under the trademark DOUBLE LOCK. In such apparatus, a lockable collar is attached by means of bearings to one extended end of the screw shaft. The collar is then spring biased relative to the base member. In the operation of such apparatus, the sequential engaging and release of workpieces may, to some extent, be accomplished. However, because the collar is attached to one end of the screw shaft and means are provided intermediate the locking collar and the base, the overall length of the work holding system is unnecessarily increased. Those skilled in the art will appreciate that due to the plethora of functions performed by the many machining elements of modern machine tools, a large workpiece holding apparatus interferes with the desired functioning of the machining apparatus and serves as a limitation on the size of workpiece which may be accommodated.

The subject invention is directed to an improved apparatus for holding two workpieces relative to a fixed location which overcomes, among others, the above-described problems and provides a vise which may engage one workpiece and retain it prior to another, and may release one workpiece while retaining another, and which is of a compact size so as to minimize interference with machining operations.

SUMMARY OF THE INVENTION

In accordance with the present invention, apparatus is provided for holding two workpieces each relative to a fixed reference location for machining operations. The apparatus disclosed includes a base member having a longitudinal slot along its axis. A fixed central jaw member having opposed jaw faces is secured intermediate the length of the base member.

A first slide member having a first jaw face is slideably received within the longitudinal slot on the base member. The first slide member may be displaced relative to the base member toward and away from the central jaw member. In addition, a second jaw member having a second jaw face is slideably received within the slot on the base on the opposite side of the central jaw member from the first slide. A screw shaft is threadably received at one end thereof within a threaded bore in the first slide member. The body of the slide member passes through a bore through the second slide member, but is configured so as to move the second slide member by means of thrust bearings provided between the second slide and the screw shaft. Also, the other end of the screw shaft is provided with means to receive a handle or other means for providing rotational movement to the screw shaft.

As such, when the screw shaft is rotated, the first slide is displaced toward the central jaw member until the first jaw contacts a workpiece therebetween. As the screw shaft is advanced it moves the second jaw face of the second slide member relative to the central jaw member to retain another workpiece therebetween.

In accordance with the present invention, a biasing means is provided which, when activated, serves to bias the second slide toward the central jaw member to controllably retain a workpiece therebetween. In particular, a block member is provided adjacent to the remote end of the first slide member and is also slideably received in the slot in the base member. The block member is attached to the first slide member by spring tube assemblies. The spring tube assemblies include spring tubes having outwardly extending flanges which engage the outer ends of bores through the block member. The other ends of the spring tubes extend into the first slide member and are inwardly turned so as to receive compression springs coaxially therein. In addition, shoulder screws are provided coaxially within the compression springs and have shoulders to receive the ends of the compression springs. Further, means are provided on the block member for securing it to the base member, such means preferably include a locking screw.

In accordance with the operation of the present invention, when the locking screw causes the block member to be secured to the base member, and the screw shaft is rotated so as to cause the displacement of the first slide toward the central jaw member, the spring means tend to resist this force and thereby urge the second slide member toward the central jaw member to thereby retain a workpiece disposed therebetween. Because the block member is attached intermediate the first slide and the base member, the overall length of the workholding system is not increased while the ability to sequentially engage and release workpieces with a compact apparatus is provided.

These and other details, objects and advantages of the present invention will become apparent as the following description of the present preferred embodiment thereof proceeds.

BRIEF DESCRIPTION OF THE DRAWING FIGURES

In the accompanying drawings I have shown a present preferred embodiment of the invention wherein.

DETAILED DESCRIPTION OF THE PREFERRED EMBODIMENTS

Figure 1:
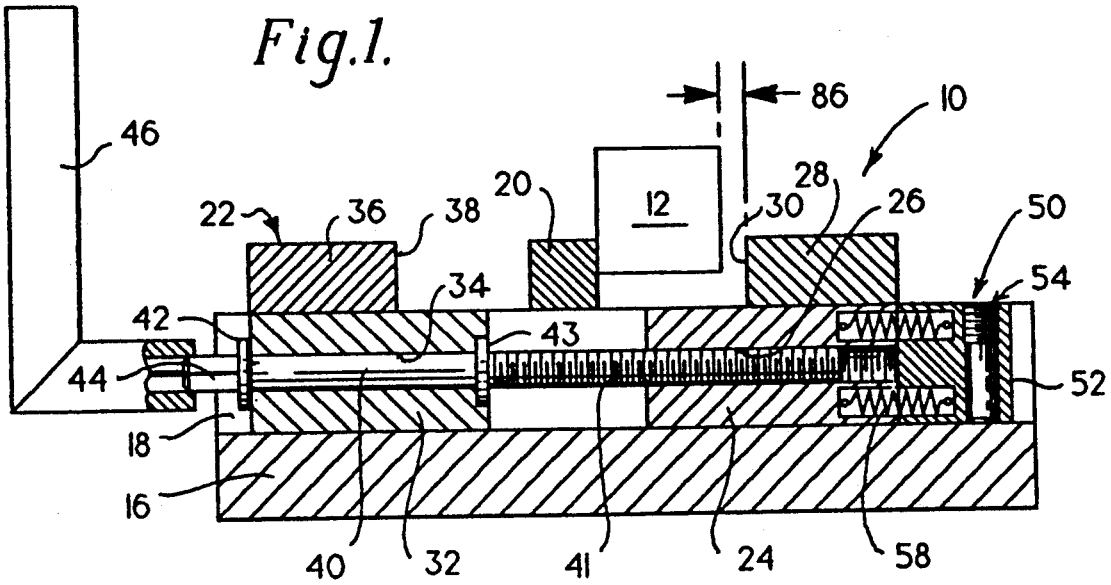
FIG. 1 is a side elevation sectional view of the invention in one position.

Referring now to the drawings wherein the for purposes of illustrating the present preferred embodiments of the invention only and not for purposes of limiting same, the Figures show a workholding vise 10 which is intended for use in connection with machining operations.

More particularly, and with reference to FIG. 1, there is shown a workholding vise 10 which securely restrains a first part 12 and a second part 14 during machining operations. The basic structure of the workholding vise 10 is similar to the vise structure described in Krason, et al., U.S. Pat. No. 4,529,183, issued July 16, 1985, entitled "Method of Machining and Vice for Use Therein", the disclosure of which is incorporated herein by reference. As such, in the present Detailed Description of the Preferred Embodiments, the basic structure of the vise 10 will be described in general terms, it being understood that the particular details of the vise 10 construction, with the exception of those features which are described hereinbelow forming the present invention, may be gleaned from a review of such patent.

The workholding apparatus 10 generally comprises a base member 16 which is an elongated metallic structure having a longitudinal axis with a longitudinal slot 18 machined therein. I prefer that the base 16 be formed from a high strength aluminum material which is hard-coated and impregnated with Teflon® to improve its efficiency and accuracy of clamping. In addition, a central fixed jaw member 20 is rigidly secured to the base 16 either by welding or by other attachment means, such as machined screws. In any event, in operation, central jaw member 20 is immovably attached to the base member 16.

A free-floating clamping assembly, generally indicated as 22, is provided for slideable movement within the slot 18 in the base member 16. The clamping assembly 22 includes a first slide member 24 which is slideably received within the longitudinal slot 18. The first slide 24 is disposed for movement within the slot 18 toward and away from the fixed jaw member 20. Further, the first slide member 24 also includes a longitudinal threaded bore 26 therethrough. The first slide member 24 includes also a workholding jaw portion 28 attached thereto, preferably by removable means, in order to provide a first jaw face 30 which may hold the first part 12 between the first jaw face 30 and one side of the fixed jaw member 20.

A second slide member 32 is also provided for sliding movement within the longitudinal slot 18 for movement toward and away from the other side of the fixed jaw member 20. The second jaw member 38 preferably has a bore 34 therethrough. The second slide 32 is provided with a second jaw member 36 which is preferably removably attached thereto, and includes a second jaw face 38 to engage the second workpiece 14 and retain it against the other side of the fixed jaw member 20. By means of example, I prefer that the first jaw member 28 be configured with respect to the first slide 24 and that the second jaw member 36 be configured relative to the second slide member 32 in the manner depicted in my copending U.S. patent application Ser. No. 306,511, filed Feb. 6, 1989, entitled "Quick-Change Head For Precision Machine Vice". The disclosure of that application is also incorporated herein by reference. I also prefer that the central jaw member 20 and the assemblies of the first slide 24 and second slide 32 be constructed from a high strength aluminum material.

The clamping assembly 22 is also provided with a screw shaft 40. One end of the screw shaft 40 is provided with threads 41 thereon which are intended to engage the threaded bore 26 within the first slide member 24. In addition, the screw shaft 40 includes means for engaging and displacing the second slide member 32. Such means may include a collar 42 attached to one end of the screw shaft 40 by means of thrust washers and a retaining collar 43 attached to the screw shaft 40 adjacent to the other end of the second slide member 32. Those skilled in the art will also appreciate that other means may be provided for moving the second slide member 32 by the screw shaft 40. For example, additional threads on the screw shaft 40 may be provided to engage a threaded bore formed through the second slide member 32. In any event, the screw shaft 40 passes axially through the second slide member 32. The other end of the screw shaft 40 provides a receptacle 44 for receiving rotary motion which is input to the screw shaft 40. For example, the receptacle 44 may receive a handle 46 which may be employed to rotate the screw shaft 40. It will be understood that when the screw shaft 40 is rotated, the first slide 24 is moved relative thereto, thereby causing the first jaw face 30 to move toward the central jaw member 20 to withhold a first part 12 therebetween. In addition, the rotation of the screw shaft 40 and its movement relative to the first slide 24 causes the collar 42 to move the second slide 32 toward the fixed jaw member 20 so that the second jaw face 38 may engage and restrain a second part 14. However, as mentioned earlier, the device described immediately above does not afford the opportunity for the operator to simultaneously hold a first workpiece, rotate the shaft and hold and position a second workpiece. Accordingly, the remainder of the present detailed Description of the Preferred Embodiment will be directed toward the present invention which provides means for overcoming such limitations without increasing the length of the apparatus 10.

Figure 2:
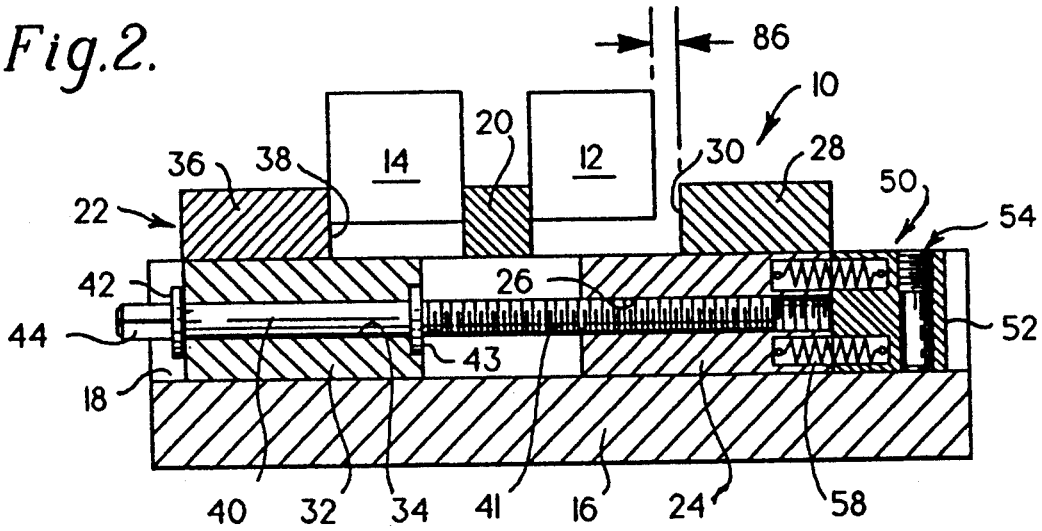
FIG. 2 is a side elevation sectional view of the invention in another position.
Figure 3:
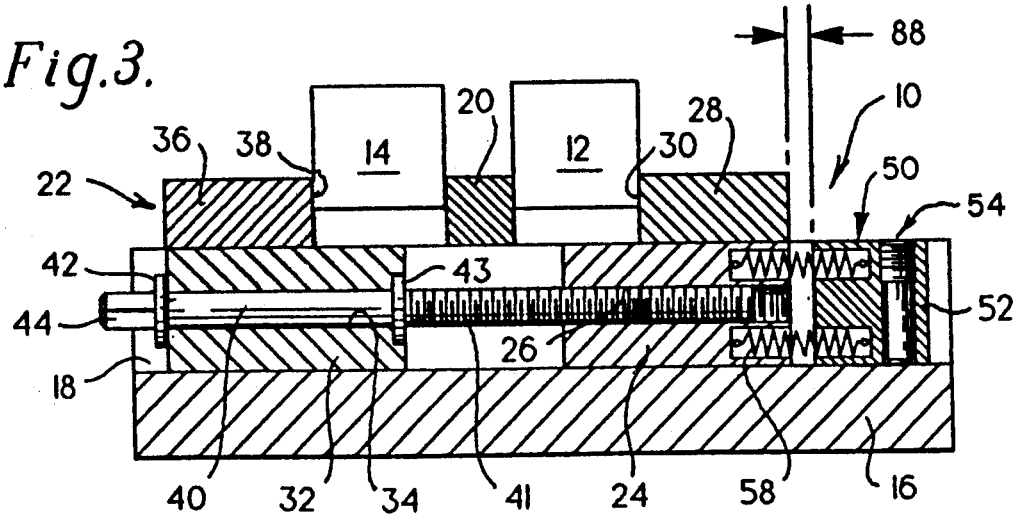
FIG. 3 is a side elevation sectional view of the invention in yet another position.

The instant invention is directed toward a means for allowing the free-floating clamping assembly 22 to hold one part or workpiece while the handle 46 is rotated while allowing the positioning of another part. The above-described problems are alleviated by the provision of a biasing means 50. The biasing means 50 includes a block member 52 which is provided within the longitudinal slot 18 immediately adjacent to the end of the first slide 24 remote from the central jaw 20. FIGS. 1 through 3 diagrammatically illustrate the principles performed by the biasing means 50; however, reference will be made hereinbelow to FIGS. 4 through 6 for the details of the biasing means 50. Generally speaking, the biasing means 50 includes means 54 for securing the block member 52 relative to the base member 16. In addition, the biasing means 50 includes means attached between the first slide 24 and the block member 52 for generating a force tending to draw such objects together. For example in FIGS. 1 through 3, the means for generating such force is generally shown as tension springs 58 connected between the block member 52 and the first slide member 24.

Figure 4:
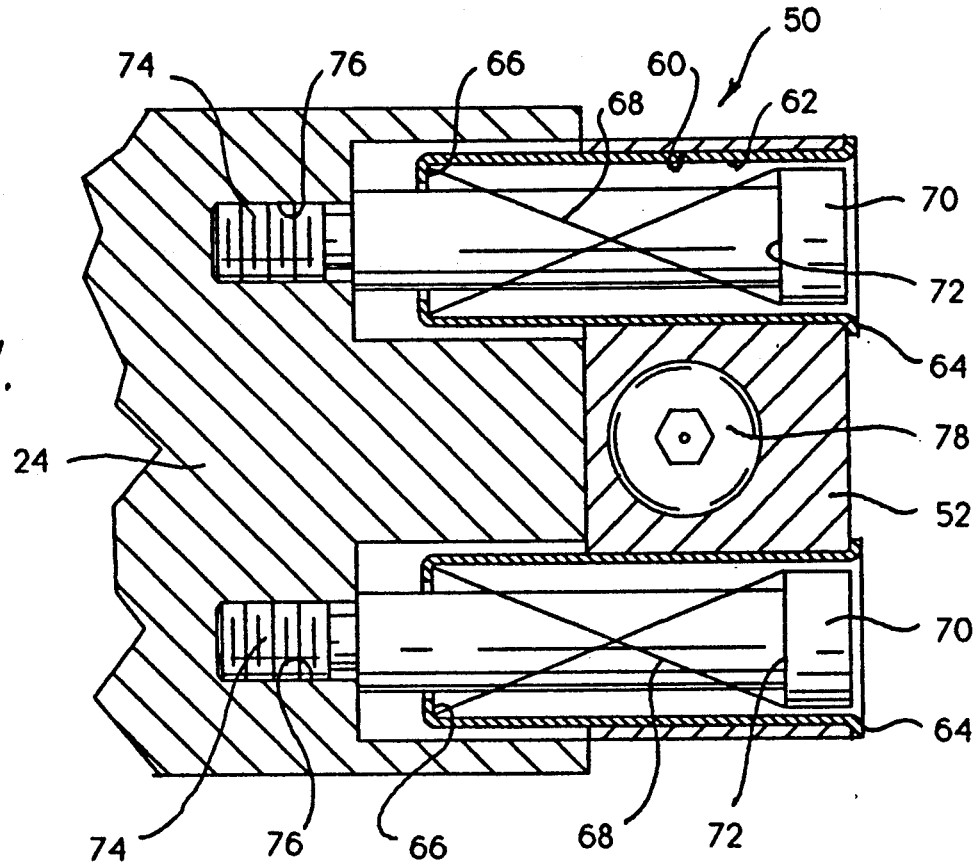
FIG. 4 is a top sectional view of the biasing means of this invention.
Figure 5:
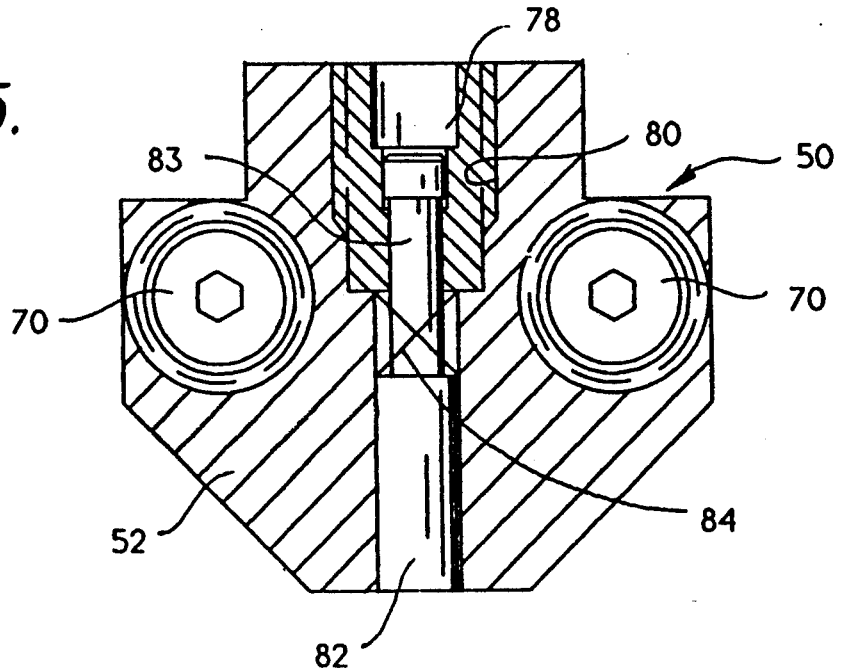
FIG. 5 is an end elevation sectional view of the biasing means.
Figure 6:
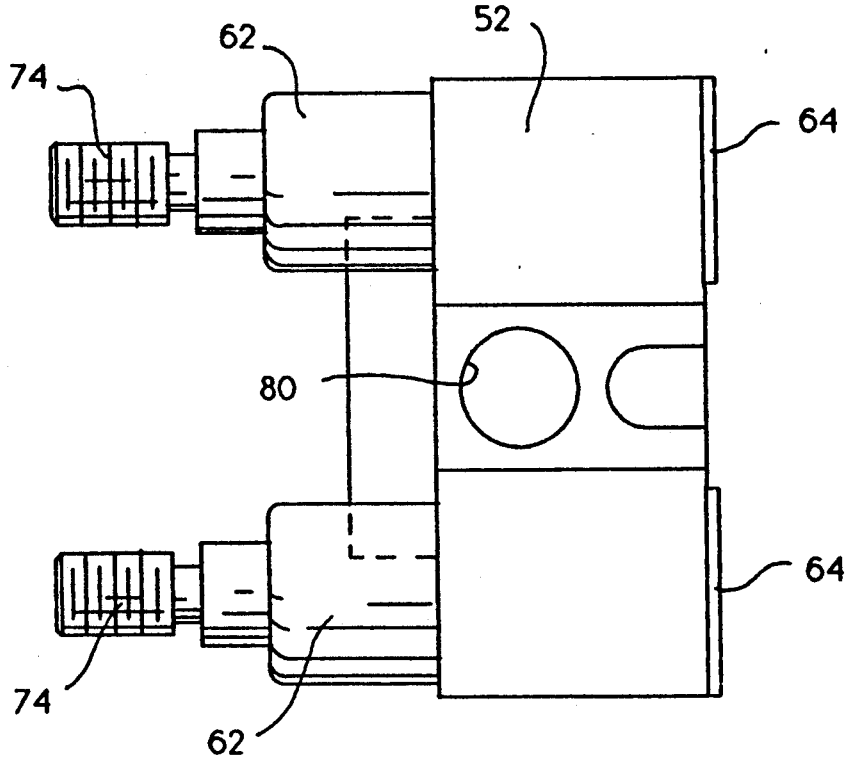
FIG. 6 is a top plan view of the biasing means of the instant invention.

Reference will now be made to FIGS. 4–6 for an explanation of the preferred embodiment of the biasing means 50. The preferred embodiment of the biasing means 50 includes bores 60 provided through the block member 52 longitudinally toward the first slide member 24. Provided within each of such bores is a spring tube 62 which is a tubular member having an outwardly extending shoulder 64 and an inwardly extending shoulder 66. A compression spring 68 is coaxially provided within each of the spring tubes 62. It will be appreciated, therefore, that the inward shoulder 66 prevents the movement of the compression spring 68 through the spring tube 62.

Coaxially disposed through each compression spring 68 is a shoulder screw 70. Shoulder screw 70 has a shoulder 72 which engages the other end of the compression spring 68. The other end of the shoulder screw 70 is provided with threads 74 which are intended for engagement with threaded bores 76 provided in the first slide member 24. In the assembly of the biasing means 50, the spring tubes are inserted through the bores 60 in the block member 52, the compression springs 68 are inserted into the spring tubes and then the shoulder screws 70 are placed through the spring tube and their threaded ends 74 are threaded into the threaded bores 76 in the first slide member 24. When the shoulder screws 70 are tightened, the compression springs 68 serve to generate forces tending to move the first slide 24 toward the block member 52.

As described above, the biasing means 50 also includes a means 54 for securing the block member 52 to the base member 16. While such means may include a simple threaded screw having an extended portion which passes through the block member 52 to engage the lower portion of the longitudinal slide 18 in the base member 16, I prefer to provide a somewhat more sophisticated securing means. In particular, I prefer that the securing means includes a threaded member 78 which may engage a threaded bore 80 which passes transverse to the block member 52. A post member 82 which is preferably constructed of a soft wearable material, is connected to the longitudinal end of threaded member 78 by means of a shaft member 83. In addition, I prefer to provide spring members 84 along the shaft 83 of the post member 82. As such, when the threaded member 78 is threaded through the threaded bore 80, the post member 82 is caused to engage the opposed face of the longitudinal slot 18 in the base member 16. This action serves to fix block member 52 relative to the base member 16. In turn, when the block member 52 is secured to the base member 16, the movement of the first slide 24 relative to the block member 52 is resisted by the compression springs 68.

In the operation of the present invention, the first part 12 is held by an operator adjacent to the fixed jaw member 20. The first slide 24 is then displaced by turning the screw shaft 40 so as to provide a predetermined gap 86 between the workpiece 12 and the jaw member 30. Then, the threaded member 78 is rotated so as to lock the block member 52 to the base member 16. The operator then turns the screw shaft 40 while holding the second part 14 until the second part 14 is held between the second jaw face 38 and the central jaw member 20. Further rotation of the screw shaft 40 will move the first slide 24 away from the block member 52. When the first slide 24 moves away from the block member 52, the compression springs 68 serve to apply a force on the second slide 32 thereby maintaining the second part 14 restrained, between the second jaw face 38 and the fixed jaw 20. While the second part 14 is restrained the operator is free to insert the first part 12 in its correct position and by turning the screw shaft 40 moves the first slide member 24 to cause the first part to be restrained between the first jaw face 30 and the fixed jaw member 20. At this time, a gap 88 equal to original gap 86 is created between the first slide 24 and the block member 52.

When unclamping the workholding vise 10, the benefits of the present invention are also effective. When the screw shaft 40 is rotated to release the parts, the first slide 24 will be pulled by the compression springs 68 toward the block member 52 which, it will be recalled, is clamped to the base number 16. When this occurs, the first part 12 will be released while the second part 14 is held under tension by the biasing means 50. Further rotation of the screw shaft 40 allows the first slide 24 to come into contact with the block member 52. At this point, the second jaw 36 will release the second part 14. It will be appreciated by those skilled in the art that when the work holding system 10 is adjusted as described above, the clamping procedure for first and second parts may be repeated with minimum turns required on the screw shaft 40 to clamp successive parts thereby increasing the overall productivity of the workholding system 10, the operator and the machining process as a whole.

I anticipate that other embodiments of the invention may also be employed successfully. For example, the biasing means 50 may be provided either adjacent to the first slide 24 or the second slide 32. In addition, alternative means may be provided to rotate the screw shaft 40. For example, hydraulic actuators may activate the shaft 40. Further alternatively, the block member 52 may be secured to the base member 16 by other means within the skill of those in the art. In another preferred embodiment of the invention, the second slide 32 may move relative to the shaft 40 by means of a hydraulic actuator placed therebetween to hydraulically control the movements of the first and second slide, 24 and 32, respectively.

However, an important feature of the present invention lies in the fact that the biasing means 50 is connected to a slide member, preferably the first slide 24, and is then secured to the base member 16. This construction affords the minimum possible length to the workholding vise 10 to thereby allow the maximum workpiece size within the machining envelope and to minimize its interference with the machining process. Also, when not secured to the base 16, the biasing means 50 moves along with the first slide 24.

It will be understood that various changes in the details, materials and arrangements of parts which have been herein described and illustrated in order to explain the nature of the invention may be made by those skilled in the art within the principle and scope of the invention as expressed in the appended claims.

What is claimed is:

1. Apparatus for holding a first and a second workpiece for machining operations, comprising:

a. an extended base member;

b. a central jaw member immovably attached to said base member;

c. a first slide member mounted on said base member for sliding movement toward and away from one side of said central jaw member, said first slide having a longitudinal threaded bore therein, said first slide member supporting a first jaw adapted for holding a first workpiece between said first jaw and said one side of said central jaw member;

d. a second slide member mounted on said base member for sliding movement toward and away from the other side of said central jaw member, said second slide member having a longitudinal bore therethrough, said second slide member supporting a second jaw adapted for holding a second workpiece between said second jaw and the other side of said central jaw member;

e. a screw shaft extending longitudinally between said first and second slide members, one end of said screw shaft being threadedly received in the threaded bore in said first slide member, said screw shaft including means for engaging said second slide member so as to cause its movement relative to said central jaw member, the other end of said screw shaft including means for accepting the input of rotary motion to said screw shaft; and f. means for selectively biasing one of said slide members toward said central jaw member, comprising:

(1) a block member mounted on said base member adjacent to the other of said slide members on the side thereof opposite from said central jaw member;

(2) spring means connecting said block member to said other of said slide members so as to normally urge said other of said slide members toward said block member;

(3) said block member including means for releasably securing said block member to said base member so that said block member may travel with said other of said slide members or be secured to said base member such that when said block member is secured to said base member, the movement of said other of said slide members away from the block member causes the spring means to bias said one slide member toward said central jaw member to retain a workpiece between the jaw corresponding to said one slide member and said fixed jaw member.

2. Apparatus of claim 1 in which said one of said slide members comprises said first slide member.

3. Apparatus of claim 1 in which said spring means comprises:

a. a spring tube comprising a tube having an outwardly extending shoulder on one end thereof and an inwardly extending shoulder on the other end thereof, said outwardly extending shoulder engaging the outer periphery of a longitudinal bore provided through said block member extending toward said other of said slide members;

b. a compression spring coaxially received within said tube, one end of said compression spring being adjacent to said inward shoulder; and c. a shoulder screw having an extended shaft passing coaxially within said spring tube and said compression spring, one end of said shoulder screw having a shoulder for engaging the other end of said compression spring and the other end of said shoulder screw having threads which are received in threaded bores in said other of said slide members.

* * * * *

UNITED STATES PATENT AND TRADEMARK OFFICE

CERTIFICATE OF CORRECTION

PATENT NO. : 5,022,636
DATED : June 11, 1991
INVENTOR(S) : George R. Swann

It is certified that error appears in the above-identified patent and that said Letters Patent is hereby corrected as shown below:

Col. 3, line 43, after "the" and before "for" insert --showings are--.

Signed and Sealed this

Fifth Day of January, 1993

*Attest:*

*Attesting Officer*

DOUGLAS B. COMER

*Acting Commissioner of Patents and Trademarks*